US005844213A

United States Patent [19]

Peysakhovich et al.

[11] Patent Number: 5,844,213

[45] Date of Patent: Dec. 1, 1998

[54] INDUCTION HEATING COIL ASSEMBLY FOR PREVENTION OF CIRCULATING CURRENTS IN INDUCTION HEATING LINES FOR CONTINUOUS-CAST PRODUCTS

[75] Inventors: Vitaly Peysakhovich, Moorestown, N.J.; Edward Rylicki, Utica, Mich.

[73] Assignee: Inductotherm Corp., Rancocas, N.J.

[21] Appl. No.: 525,322

[22] Filed: Sep. 8, 1995

Related U.S. Application Data

[63] Continuation-in-part of Ser. No. 384,080, Feb. 6, 1995, Pat. No. 5,550,353, which is a continuation-in-part of Ser. No. 107,427, Aug. 16, 1993, Pat. No. 5,416,794, which is a continuation-in-part of Ser. No. 19,921, Feb. 19, 1993, Pat. No. 5,425,048, which is a continuation-in-part of Ser. No. 532,010, Jun. 1, 1990, Pat. No. 5,272,720, which is a continuation-in-part of Ser. No. 473,000, Jan. 31, 1990, Pat. No. 5,257,281.

[51] Int. Cl.[6] ..... H05B 6/36

[52] U.S. Cl. ..... 219/672; 219/647; 219/653

[58] Field of Search ..... 219/602, 607, 219/624, 635, 636, 637, 643, 647, 653, 672, 674, 676; 373/151–155; 156/498

[56] References Cited

U.S. PATENT DOCUMENTS

| | | | |
|---|---|---|---|
| 2,676,242 | 4/1954 | Witseburg . | |
| 2,689,296 | 9/1954 | Sabol . | |
| 3,301,991 | 1/1967 | Geisel et al. . | |
| 3,395,261 | 7/1968 | Leatherman et al. . | |
| 3,446,930 | 5/1969 | Seulen et al. . | |
| 3,472,987 | 10/1969 | Viart . | |
| 3,741,280 | 6/1973 | Kozheurov et al. . | |
| 3,766,353 | 10/1973 | Barbieux . | |
| 4,778,971 | 10/1988 | Sakimoto et al. . | |
| 5,156,683 | 10/1992 | Ross . | |
| 5,257,281 | 10/1993 | Cignetti et al. | 373/155 |
| 5,272,720 | 12/1993 | Cignetti et al. | 373/155 |
| 5,317,121 | 5/1994 | Katayama et al. . | |
| 5,345,065 | 9/1994 | Reinke et al. . | |
| 5,416,794 | 5/1995 | Cignetti et al. | 373/153 |
| 5,425,048 | 6/1995 | Heine et al. | 373/151 |
| 5,550,353 | 8/1996 | Peysakhovich et al. | 219/672 |

FOREIGN PATENT DOCUMENTS

| | | |
|---|---|---|
| 0 637 897 | 7/1994 | European Pat. Off. . |

*Primary Examiner*—Tu B. Hoang

*Attorney, Agent, or Firm*—Seidel, Gonda, Lavorgna & Monaco, P

[57] ABSTRACT

An induction heating coil assembly for use in a roller induction heating line has a magnetic shunt for receiving a portion of an electromagnetic field generated along the axis of the induction coil and directing that portion along a path parallel to a workpiece passing along the heating line. This flux path ensures that eddy currents induced in the workpiece flow primarily perpendicular to the axis of the workpiece, and not along the axis of the workpiece where they could cause arcing between the moving workpiece and the conveyor rolls.

47 Claims, 14 Drawing Sheets

INDUCTION HEATING COIL ASSEMBLY FOR PREVENTION OF CIRCULATING CURRENTS IN INDUCTION HEATING LINES FOR CONTINUOUS-CAST PRODUCTS

CROSS-REFERENCE TO RELATED APPLICATIONS

This is a continuation-in-part application of application Ser. No. 08/384,080, filed Feb. 6, 1995, now U.S. Pat. No. 5,550,353, which is a continuation-in-part of application Ser. No. 08/107,427 filed Aug. 16, 1993, now U.S. Pat. No. 5,416,794, which is a continuation-in-part of application Ser. No. 08/019,921 filed Feb. 19, 1993, now U.S. Pat. No. 5,425,048, which is a continuation-in-part of application Ser. No. 07/532,010 filed on Jun. 1, 1990, now U.S. Pat. No. 5,272,720, which is a continuation-in-part of application Ser. No. 07/473,000 filed Jan. 31, 1990, now U.S. Pat. No. 5,257,281, the disclosures of each of which are incorporated herein by reference.

FIELD OF THE INVENTION

The present invention relates to induction heating of continuous-cast products such as slabs, billets, bars, and the like.

BACKGROUND OF THE INVENTION

It is often desired to heat continuous-cast products (e.g., slabs, billets, or other workpieces) as they are conveyed along a path from one location to another. Typically, such products are conveyed by conveyor rolls, which support the product from below and are driven to impart linear motion to the product.

A typical roller induction heating line 10 for continuous-cast products according to the prior art is illustrated schematically in FIG. 1. A continuous-cast product such as a tubular workpiece 12 is conveyed from right to left as viewed in FIG. 1 by steel conveyor rolls 14 and 16. Conveyor rolls 14 and 16 are journaled for rotation in a supporting frame, and are rotationally driven, in known manner, in a counterclockwise direction as viewed in FIG. 1. The rotation of conveyor rolls 14 and 16 imparts linear movement of the tubular workpiece 12 from right to left, as indicated by the large arrow at the top of FIG. 1.

As the tubular workpiece 12 is conveyed by conveyor rolls 14 and 16, it passes through an induction heating coil 18. The induction heating coil 18 is a conventional helically-wound coil known in the art. The induction heating coil 18 is excited by a high frequency ac power supply 20, also known in the art, and generates an electromagnetic field through which the tubular workpiece 12 passes. Typically, the tubular workpiece 12 is positioned so that its axis is collinear with the axis of coil 18. The electromagnetic field produced by induction coil 18 induces the flow of eddy currents in the tubular workpiece 12. The electrical resistance of the tubular workpiece 12 to the induced eddy currents results in $I^2R$ heating of the tubular workpiece 12.

Problems arise, however, because the induction coil 18 generates a small, but non-negligible, component of the electromagnetic field perpendicular to the axis of the coil and, thus, along the axis of the tubular workpiece 12. This component of the electromagnetic field produces an electric current which flows along the axis of the tubular workpiece 12, represented by the small horizontal arrows pointing to the right in FIG. 1. This current, referred to as a parasitic current, begins to circulate along a path from the tubular workpiece 12 and into conveyor rolls 14 and 16 through a common ground, such as the supporting frame in which the rolls are journaled. This path is represented by the curved path shown below the conveyor rolls in FIG. 1. (Although the figure illustrates parasitic current flow in one direction, it will be understood that the parasitic current is an alternating current since the coil is excited by an ac power supply.) This phenomenon causes arcing between the moving tubular workpiece 12 and the conveyor rolls 14 and 16, which causes pitting and other damage to the conveyor rolls.

Prior to the present invention, the most common way of preventing the flow of parasitic currents was to insulate the conveyor rolls from ground, in order to break up the current path. This involved cumbersome and expensive steps. One approach was to make the conveyor rolls out of ceramic. Ceramic conveyor rolls are very expensive, and can easily crack. Other techniques involved constructing the conveyor rolls from concentric steel inner and outer tubes insulated from each other by an intermediate insulator, such as a ceramic. Such conveyor rolls are extremely expensive to fabricate, and are subject to failure because of differential expansion and contraction between the steel and the insulating material when the rolls are subjected to the high temperatures involved in the continuous heating operation.

In some cases, no attempt was made to eliminate the parasitic currents. The currents were allowed to flow, and the conveyor rolls were periodically removed from the line and resurfaced to remove the pitting. Clearly, none of these approaches is very satisfactory.

The present invention provides a way of preventing the flow of parasitic currents. Consequently, the present invention prevents the damage to the conveyor rolls which parasitic currents cause, and eliminates the need for special conveyor rolls and insulating schemes to block the flow of parasitic currents. The present invention makes roller induction heating easier and cheaper than prior approaches.

SUMMARY OF THE INVENTION

The present invention is directed to an induction heating coil assembly for use in a roller induction heating line. The induction heating line comprises conveyor rolls for conveying a workpiece (e.g., a slab) to be inductively heated along a linear path and an induction heating coil assembly surrounding the path. The induction heating coil assembly has a central axis and comprises an induction coil and a magnetic shunt surrounding the coil. The induction coil has a plurality of turns and is shaped to define a preselected perimeter for permitting the workpiece to be received within the perimeter. The magnetic shunt includes first and second pluralities of transverse yokes at opposite ends of the coil, and a plurality of intermediate yokes spaced apart from each other. The intermediate yokes are disposed between the first and second pluralities of yokes and extend parallel to the axis of the coil. The intermediate yokes extend around the perimeter defined by the induction coil. The first and second pluralities of yokes are axially separated from each other and electro-magnetically coupled together by the plurality of intermediate yokes.

A second embodiment of the invention permits the induction heating apparatus to be placed around a strip material workpiece that is already in place on a conveyor. This embodiment comprises one or more full turn coils connected to each other and having a gap in one end. The gap allows the apparatus to be moved over a strip workpiece such that the workpiece passes between the open ends of the full turn coils and is encompassed by the apparatus. This embodiment further comprises a plurality of magnetic yokes disposed along elongated induction segments that comprise the coil turns. The yokes extend along the induction segments for a distance at least equal to the width of the strip workpiece and are arranged parallel to the longitudinal axis of the workpiece. A magnetic field reducer is located in the gap end of the apparatus and magnetic shunts are disposed at the opposite end of the apparatus.

In operation, the plurality of yokes function as a magnetic shunt to direct the electromagnetic field generated by the induction field along a path parallel to the axis of the coil, and thus parallel to the slab. This flux path induces eddy currents in the workpiece. However, due to the orientation of the yokes, there is no appreciable orthogonal component to the magnetic flux (i.e., there is no appreciable component perpendicular to the axis of the coil or workpiece). Accordingly, the induced eddy currents in the workpiece flow perpendicular to the axis of the workpiece. No appreciable induced parasitic eddy current flows along, or down the workpiece. Accordingly, no damaging parasitic currents circulate through the conveyor rolls.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

While the invention will be described in connection with one or more preferred embodiments, it will be understood that it is not intended to limit the invention to the described embodiments. On the contrary, it is intended to cover all alternatives, modifications and equivalents as may be included within the spirit and scope of the invention as defined by the appended claims.

Figure 1:
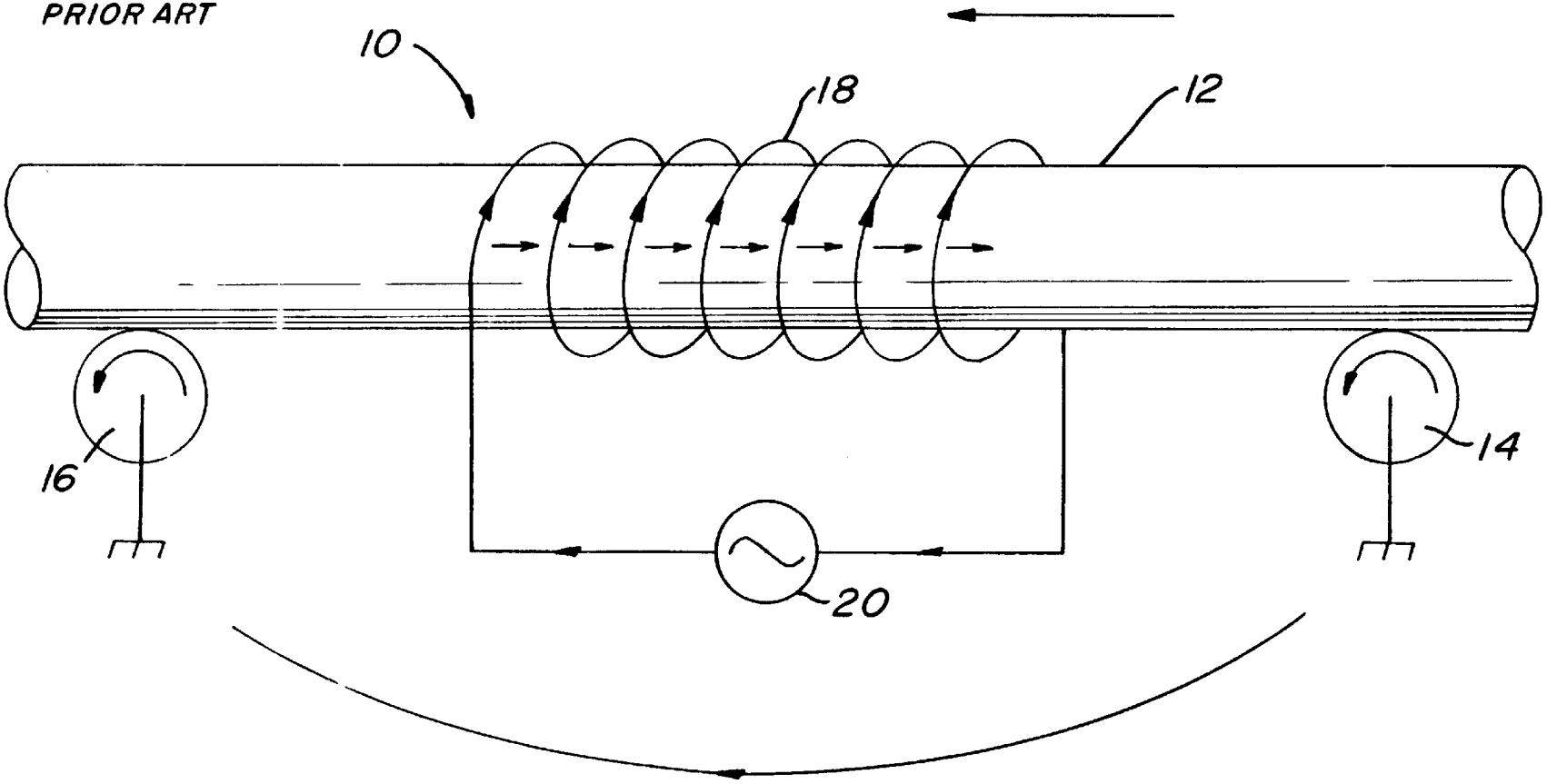
FIG. 1 PRIOR ART
FIG. 1 is a schematic representation of an induction heating coil in relation to a workpiece being heated, in accordance with the prior art.
Figure 2A:
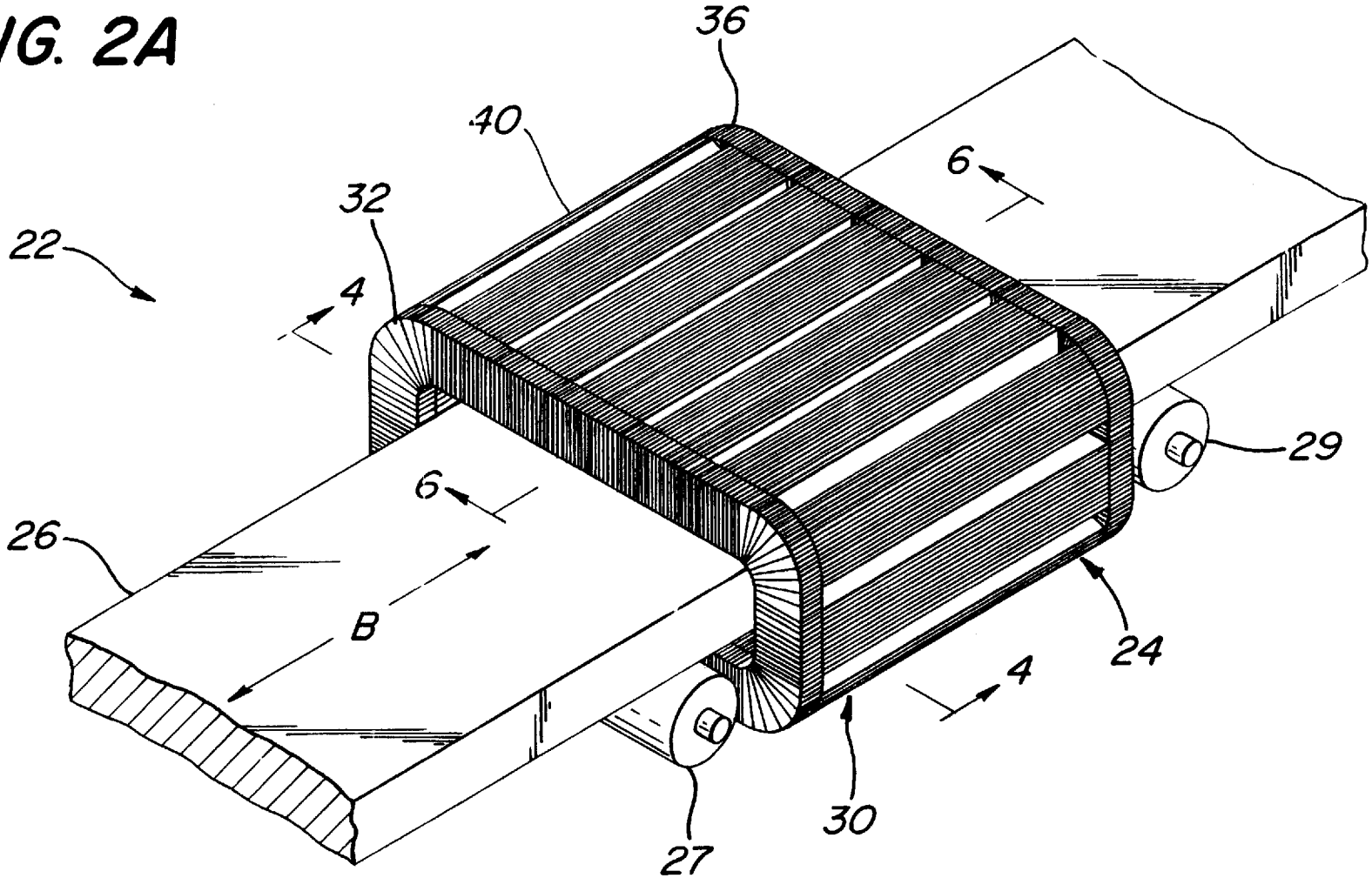
FIGS. 2A and 2B are identical perspective views of the novel induction heating coil assembly in relation to a workpiece being heated.
Figure 3:
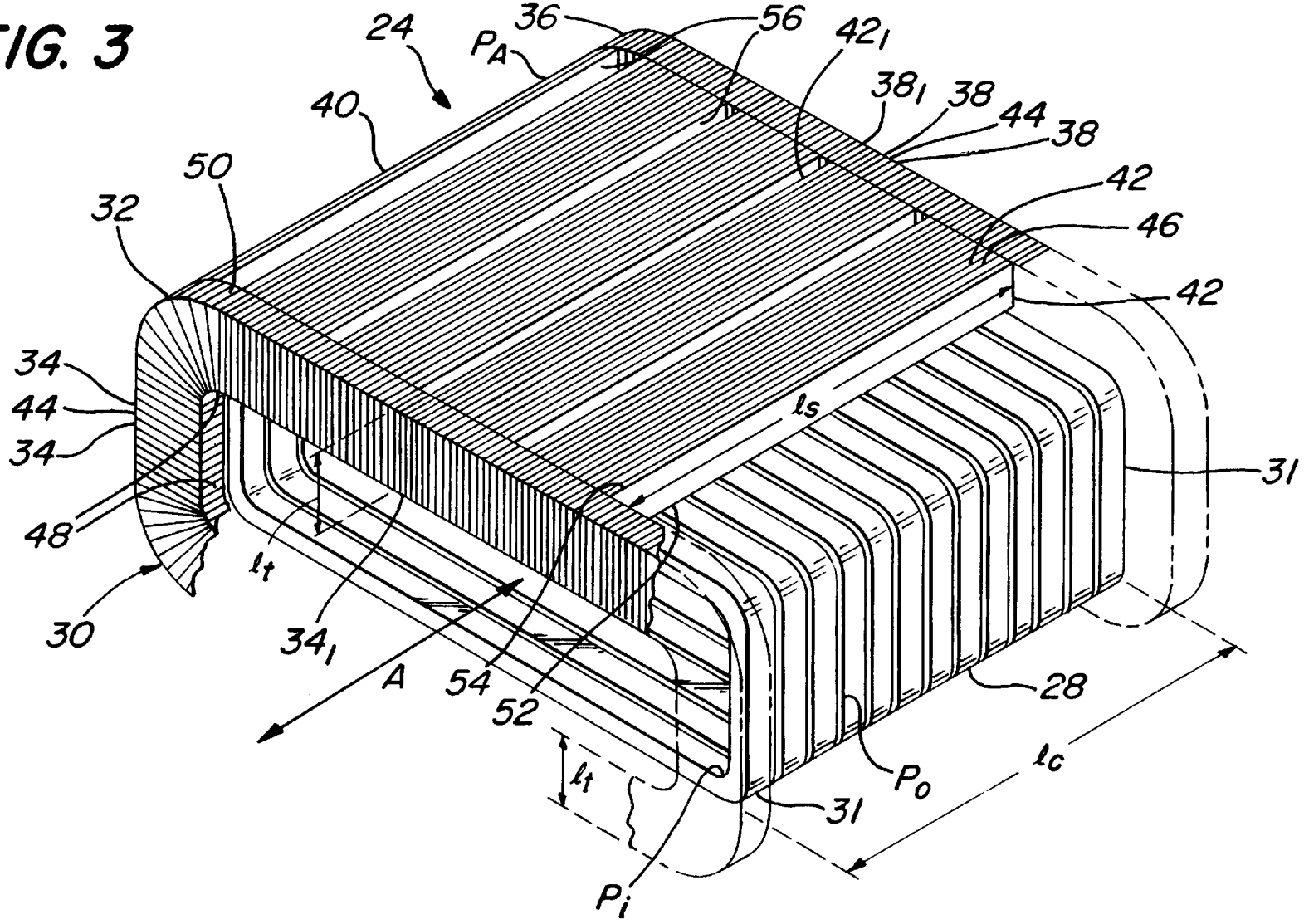
FIG. 3 is a perspective view of the novel induction heating coil assembly with a portion of the magnetic shunt removed to show the induction coil thereunder.

Referring now to the drawings, FIG. 2A shows a perspective view of roller induction heating line 22 and the novel induction heating coil assembly 24 associated therewith. FIG. 3 shows a perspective view of the novel induction heating coil assembly. For clarity, FIGS. 2A and 3 are described together. The line 22 conveys a continuous-cast workpiece such as slab 26 therealong. The line 22 may also convey workpieces having other shapes, such as the tubular workpiece 12 shown in prior art FIG. 1. As viewed in FIG. 2A, the slab 26 is linearly conveyed from right to left by steel conveyor rolls 27 and 29. These rolls operate in the same manner as described above in relation to prior art FIG. 1.

The induction heating coil assembly 24 surrounds the slab 26 so that the slab 26 passes through the coil assembly 24. The assembly 24 includes induction heating coil 28 and a magnetic shunt 30 which surrounds ends 31 and outer perimeter $P_o$ of the induction heating coil 28. The induction heating coil 28 is a conventional helically-wound coil which operates in the same manner as coil 18 described in prior art FIG. 1. The induction heating coil 28 has a central axis A and a length $l_c$. The slab 26 thus passes through an area defined by the coil's inner perimeter $P_1$ and length $l_c$. The coil 28 is preferably positioned with respect to the slab 26 so that the slab's longitudinal axis B is collinear with the induction coil's central axis A.

The magnetic shunt 30 is illustrated as having three distinct portions. The first portion comprises a first plurality 32 of individual transverse yokes 34 and the second portion comprises a second plurality 36 of individual transverse yokes 38. A third portion comprises a third plurality 40 of individual intermediate yokes 42. However, if desired, the transverse yokes and intermediate yokes may be a single unit, or joined together to form a single unit Each plurality of individual transverse yokes 34, 38 are spaced apart from each other by identically shaped non-conductive spacers 44, in a stacked or sandwiched manner. Each plurality of individual intermediate yokes 42 are also spaced apart from each other by identically shaped non-conductive spacers 46 in a similar stacked manner. One suitable non-conductive spacer material for both types of yokes is Mylar®.

As described in more detail below, the plurality of individual transverse yokes 34, 38 extend completely around all areas of the ends 31 of the induction coil 28, whereas the intermediate yokes 42 are arranged in a plurality of groupings, each grouping separated by a relatively small air gap. These air gaps create small discontinuities along the outer perimeter $P_A$ of the assembly 24.

The specific arrangement of the yokes is an important feature of the invention. The first and second plurality of individual transverse yokes 34, 38 are oriented transverse to the outer perimeter $P_o$ of induction coil 28, and are disposed at opposite ends of the coil. Each of the individual transverse yokes 34 and 38 is defined by an inner facing planar end 48 and an outer facing planar end 50. The transverse yokes 34 and 38 are placed at opposite ends 31 of the induction coil 28 so that the yokes extend axially inward slightly past the inner perimeter $P_1$ of the induction coil 28. The non-conductive spacers 44 are oriented in the same manner as the transverse yokes 34 and 38.

Figure 4:
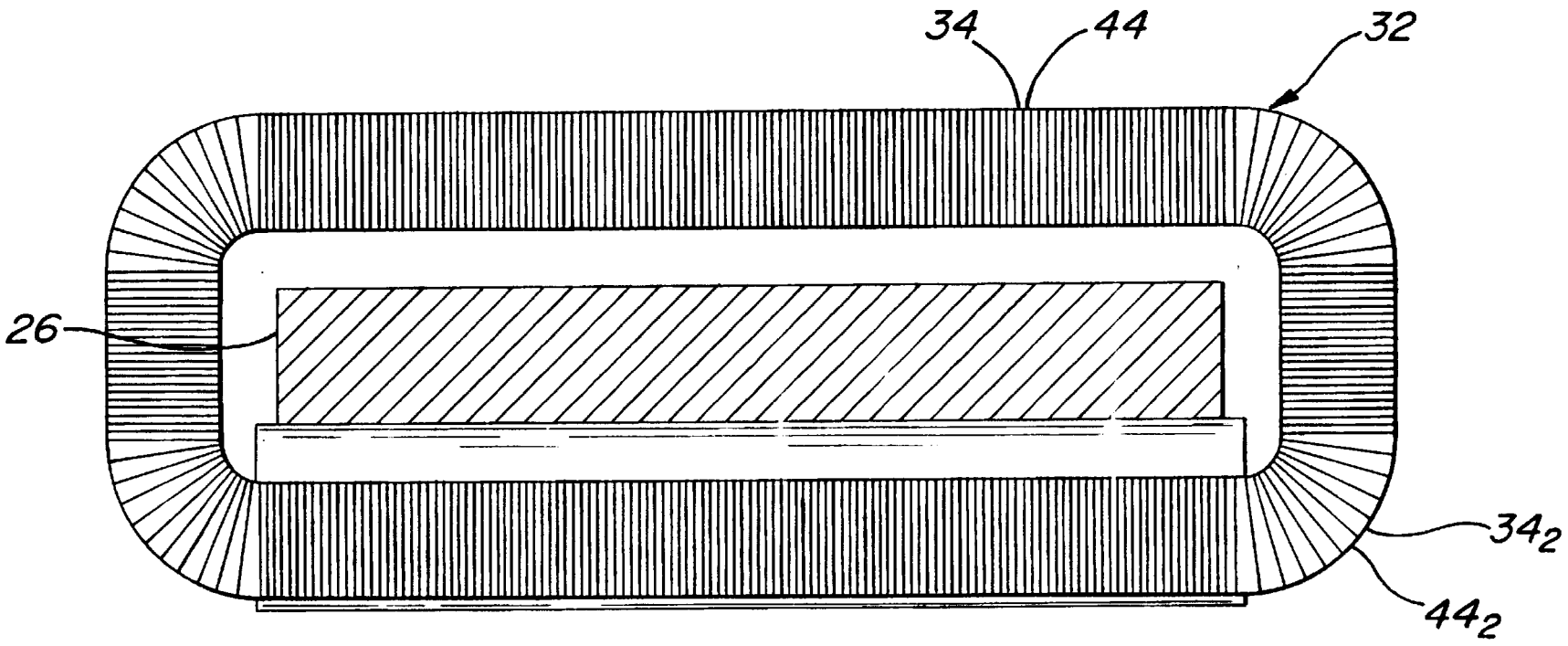
FIG. 4 is an end view taken along line 4—4 in FIG. 2A.

The transverse yokes 34, 38 and spacers 44 extend completely around, but do not touch, the ends of the perimeter of the induction coil 28. In the depicted embodiment, the yokes 34, 38 extend around the perimeter in generally the shape of a flattened oval. The transverse length $l_t$ of the yokes 34, 38 and spacers 44 is the same along the entire perimeter, and the inner and outer facing planar ends 48, 50 of the transverse yokes 34 and 38 terminate in respective common radial planes, as also illustrated in FIG. 4. To accommodate the corners of the oval configuration, the transverse yokes 34, 38 and spacers 44 along the corners are wedge-shaped.

The individual intermediate yokes 42 are disposed between the transverse yokes 34, 38 and extend parallel to the central axis A of the induction coil 28. Thus, the intermediate yokes 42 appear as radial fins extending from the induction coil 28. Each intermediate yoke 42 has a longitudinal length $l_s$, which is slightly larger than the length $l_c$ of the induction coil 28.

The plurality of intermediate yokes 42 closely surround, but do not touch, the outer perimeter $P_o$ of the induction coil 28. Each of the intermediate yokes 42 is defined by an inner facing planar end 52 and an outer facing planar end 54. The outer facing planar ends 54 of the intermediate yokes 42 terminate in the same common oval-shaped radial plane as the outer facing planar ends 50 of the transverse yokes 34 and 38. Again, the non-conductive spacers 46 are oriented in the same manner as the intermediate yokes 42.

Figure 5:
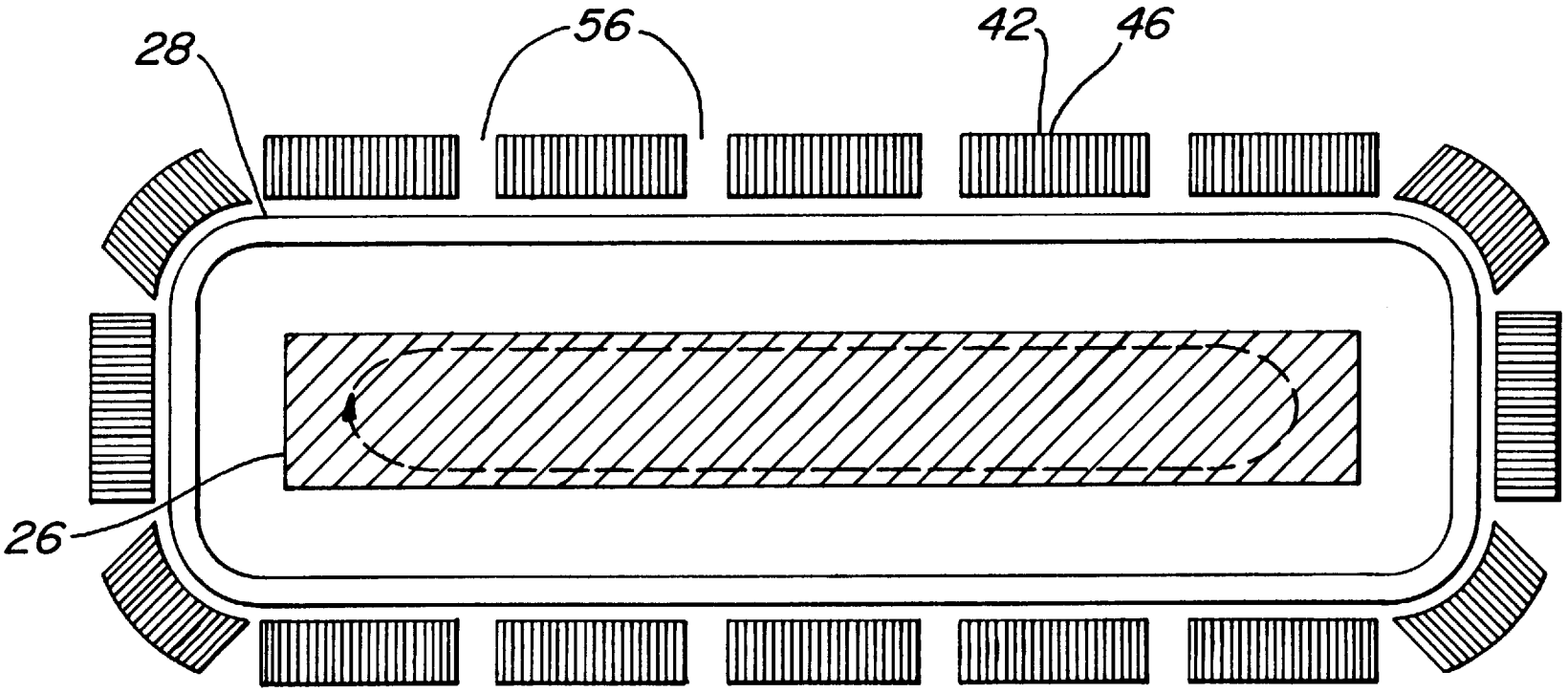
FIG. 5 is a transverse sectional view taken through line 5—5 in FIG. 6.

The transverse yokes 34 and 38 extend around the entire perimeter of respective ends of the induction coil 28, whereas the intermediate yokes 42 are arranged in spaced groupings, separated by small air gaps 56. In the embodiment described herein, there are sixteen such groupings, as best illustrated in FIG. 5.

The first and second plurality of individual transverse yokes 34, 38 are electromagnetically coupled together by respective intermediate yokes 42 which lie in the same, or closely adjacent, plane. For example, in FIG. 3, transverse yokes $\mathbf{34}_1$ and $\mathbf{38}_1$ are coupled together by intermediate yoke $\mathbf{42}_1$. This electromagnetic coupling allows magnetic flux to flow easily along the length of the magnetic shunt 30. Due to the air gaps 56, not all of the transverse yokes 34, 38 are electromagnetically coupled together by a respective intermediate yoke 42 in the same plane. These pairs of transverse yokes 34, 38 are electromagnetically coupled by way of adjacent intermediate yokes 42. Since the air gaps 56 are relatively small compared to the length of the overall magnetic flux path, there will be a small but relatively inconsequential divergence in the magnetic flux path at each end.

Figure 2B:
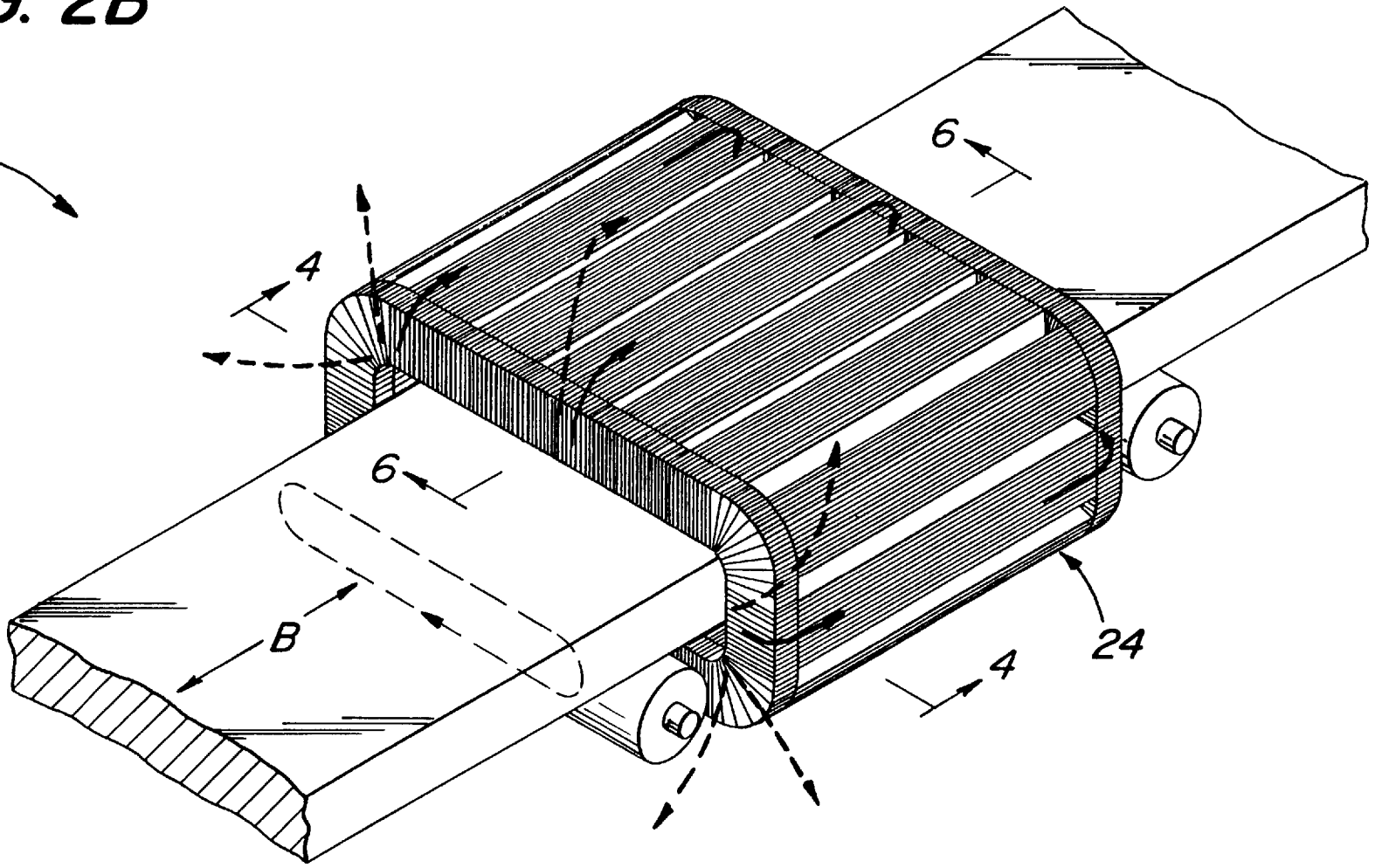

FIG. 2B is identical to FIG. 2A and illustrates the functional advantage of the induction heating coil assembly 24 during operation of the roller induction heating line 22. When power is applied to the induction coil 28 (not visible in this view), the induction coil 28 generates an electromagnetic field which has components along both a path parallel and perpendicular to the central axis A (not shown) of the induction coil 28. The perpendicular component is very small compared to the parallel component, but is nevertheless large enough to be problematic if not eliminated. The plurality of yokes in the magnetic shunt 30 direct both components of the electromagnetic field along a path parallel to the central axis A of the induction coil 28, and thus parallel to the longitudinal axis B of the slab 26. The magnetic flux induces eddy currents in the slab 26. Since the transverse yokes 34, 38 and the intermediate yokes 42 are oriented parallel to the longitudinal axis B of the slab 26, substantially all the magnetic flux is directed along this path. This path is shown in FIG. 2B as a series of solid line arrows. There is no appreciable orthogonal component to the magnetic flux. That is, there is no appreciable component perpendicular to the longitudinal axis B of the slab 26. Accordingly, the induced eddy current in the slab 26 flows primarily perpendicular to the slab's longitudinal axis B. This eddy current is shown in FIG. 2B as a dashed line arrow in the slab 26, and is best illustrated in FIG. 5. No appreciable induced parasitic eddy currents flow along, or down the longitudinal axis B of the slab 26. Accordingly, no damaging parasitic currents circulate through the conveyor rolls 27 and 29.

If the magnetic shunt 30 were not present, the electromagnetic field would spread out in all directions at the ends of the induction coil 28, as shown by the imaginary dotted line arrows, and would have a non-negligible orthogonal component. Accordingly, non-negligible parasitic eddy currents would be induced to flow in the slab 26 along the slab's longitudinal axis B, causing the problems discussed above.

Figure 6:
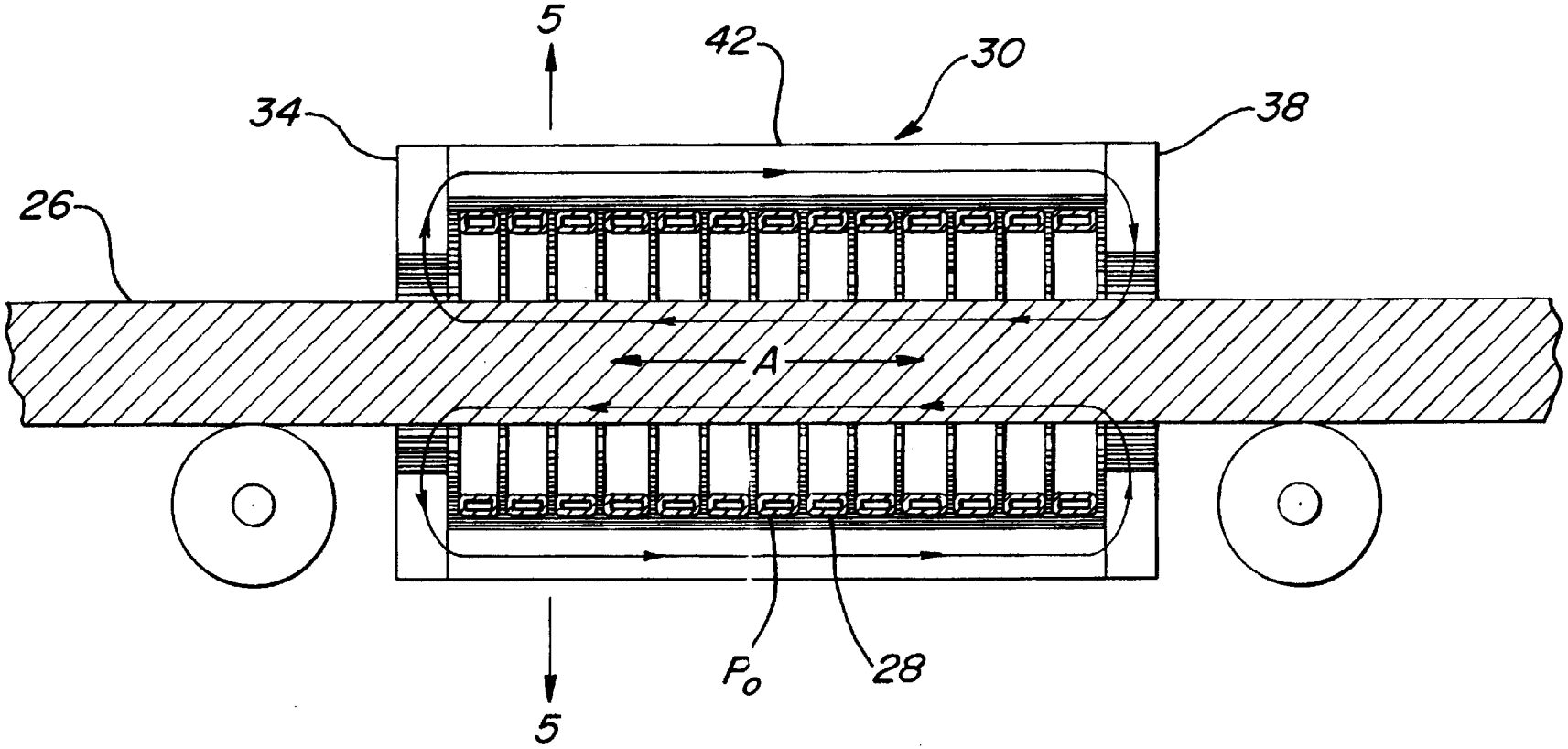
FIG. 6 is a longitudinal sectional view taken through line 6—6 in FIG. 2A.

FIGS. 4, 5 and 6 show end and sectional views taken through FIG. 2A, and more clearly illustrate certain features of the invention.

FIG. 4 is an end view taken through line 4—4 in FIG. 2A. This view shows the arrangement of the alternating first plurality 32 of individual transverse yokes 34 and non-conductive spacers 44 which completely surround the end of the induction coil 28. Since the yokes 34 and spacers 44 are sandwiched or stacked together, the induction coil 28 is not visible in this view. FIG. 4 also clearly shows the wedge-shaped transverse yokes (e.g., $\mathbf{34}_2$) and spacers (e.g., $\mathbf{44}_2$) along the corners of the oval configuration. The slab 26 to be heated is centrally disposed within the surrounding transverse yokes 34.

FIG. 5 is a transverse sectional view taken through line 5—5 in FIG. 6. This view shows the sixteen spaced groupings of intermediate yokes 42 and spacers 46, separated by small air gaps 56. One turn of the induction coil 28 is also visible in this view. FIG. 5 also shows the induced eddy current as a dashed line arrow in the slab 26. Of course, the direction of this current alternates at the same frequency as the alternating current source used excite the induction coil 28. The direction shown in FIG. 5 is that at a given instant of time.

FIG. 6 is a longitudinal sectional view taken through line 6—6 in FIG. 2A. This view shows a portion of the magnetic shunt 30 made up of two transverse end yokes 34, 38 and a connecting intermediate yoke 42 disposed in the same longitudinal plane. The plurality of turns of the induction coil 28 are also visible in this view. FIG. 6 also shows that the magnetic shunt 30 surrounds the ends and outer perimeter $P_o$ of the induction coil 28. As described above, the yokes of the magnetic shunt 30 provide a magnetic flux path for the component of electromagnetic field along the central axis A of the induction coil 28. The path through the yokes 34, 42, 38 and slab 26 is shown as a solid line arrow. Again, it should be understood that the direction of the path alternates at the same frequency as the alternating current source used excite the induction coil 28. The direction shown in FIG. 6 is that at a given instant of time.

Figure 7:
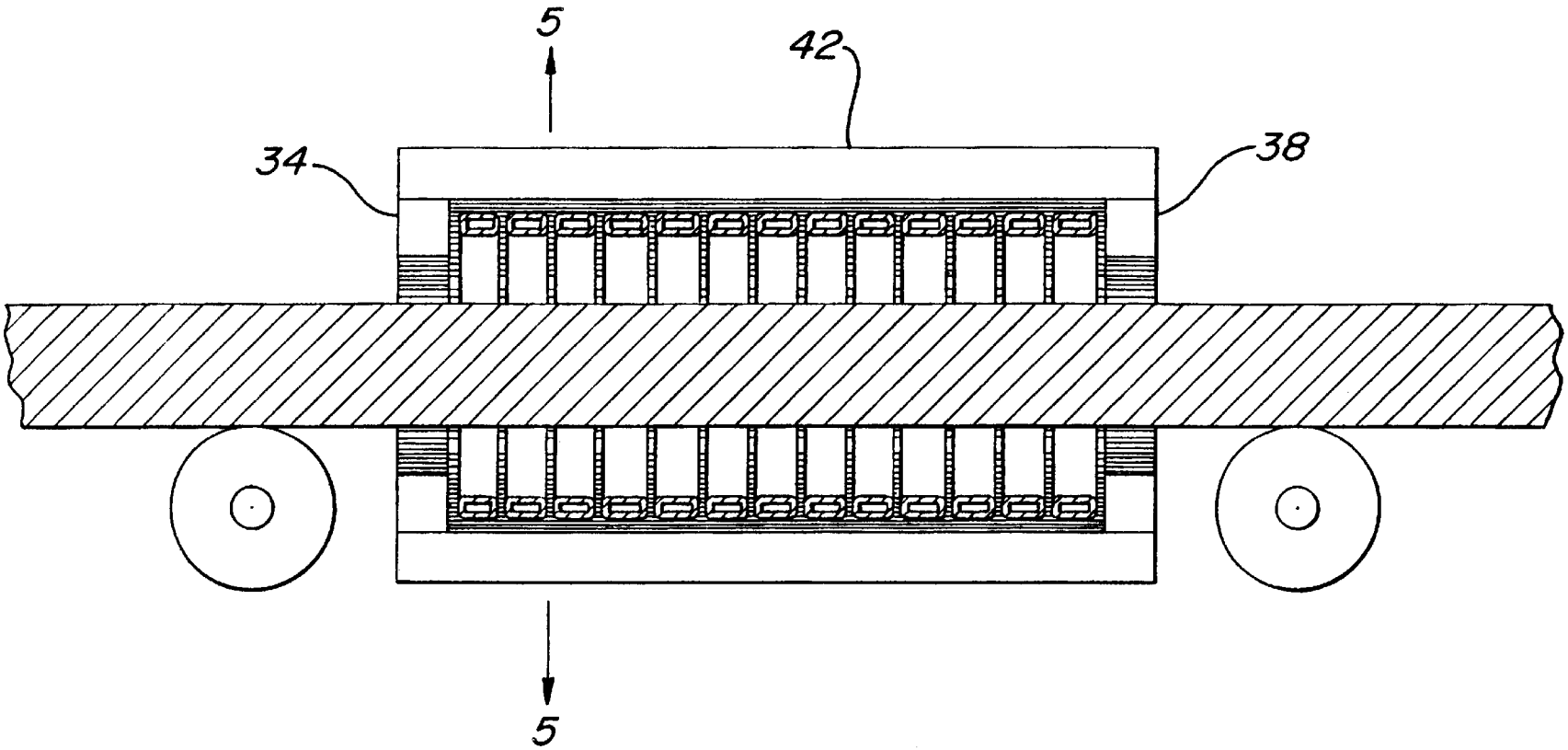
FIGS. 7 and 8 are longitudinal sectional views taken through line 6—6 of an alternative embodiment of FIG. 2A.
Figure 8:
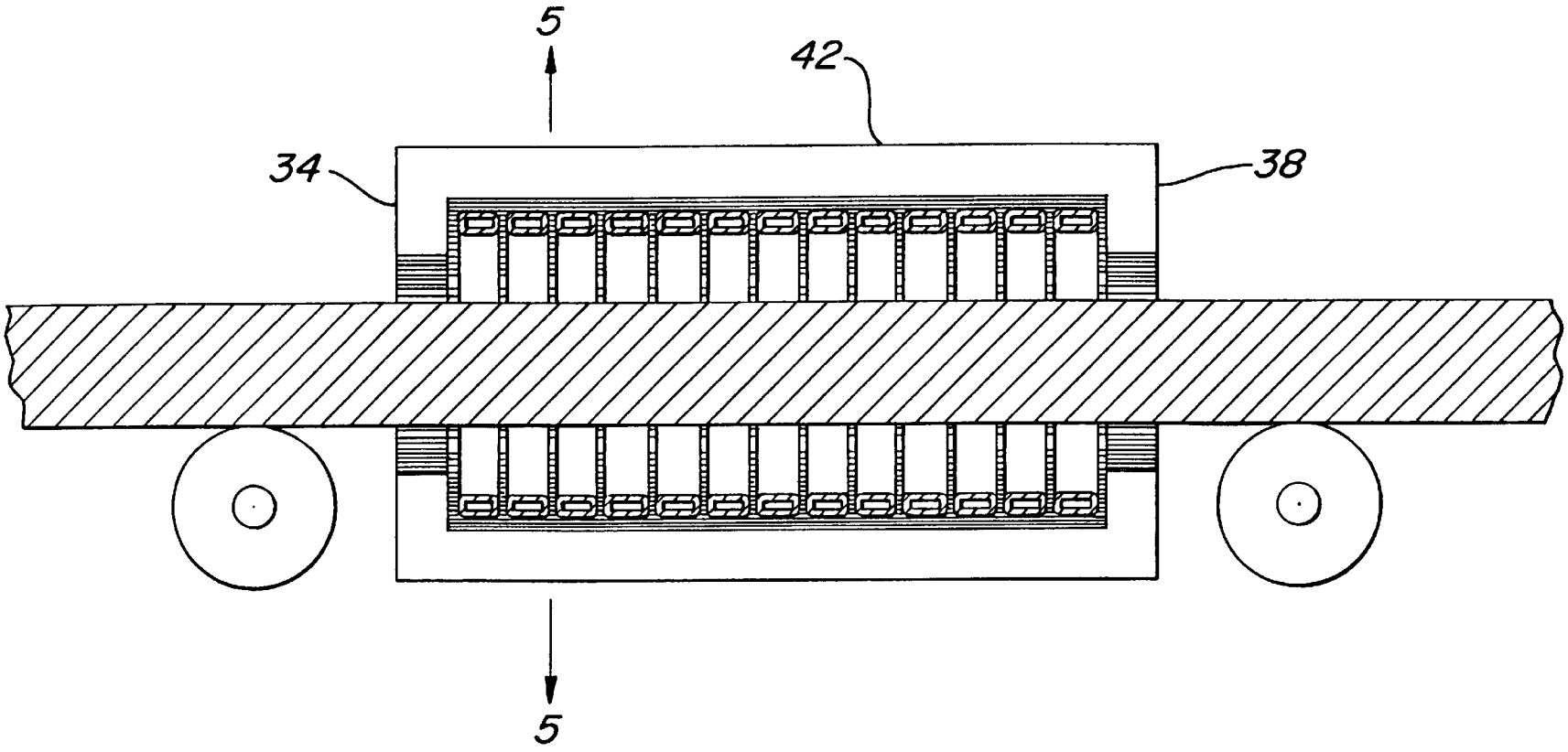

Magnetic shunts 30 may be constructed in a plurality of different ways, as shown in FIGS. 7 and 8.

In FIG. 7, the transverse end yokes 34, 38 are shorter in length and the intermediate yoke 42 is longer at each end to overlap end yokes 34 and 38. In FIG. 8, the transverse end yokes 34, 38 and the intermediate yoke 42 are formed as one continuous piece of material. The non-conductive spacers 44 and 46 may also be constructed in the same alternate configurations as the yokes.

The embodiment of the invention as illustrated and described is employed for heating rectangular-shaped loads or workpieces, such as slabs. However, the scope of the invention includes embodiments for heating other load shapes, such as tubular or cylindrical workpieces. In these alternative embodiments, the coil 28 and magnetic shunt 30 would be generally circular, not oval, in transverse section.

It will be appreciated that the coil assembly 24 will be subjected to very large mechanical forces as a result of magnetic interaction between the coil 28 and the workpiece. In a large installation, these forces could amount to several tons. Normally, in a typical cylindrical induction coil, these forces are evenly distributed about the circumference of the coil, and are therefore in balance, or radial symmetry, around the periphery of the coil. However, in the present situation, where the coil is a flattened oval, the forces will not be symmetric around the coil periphery, and there will be resulting net forces of substantial magnitude between the coil and the workpiece. To aid in strengthening coil assembly 28, the magnetic shunts may be clamped tightly against the coil turns, as shown in FIG. 9.

Figure 9:
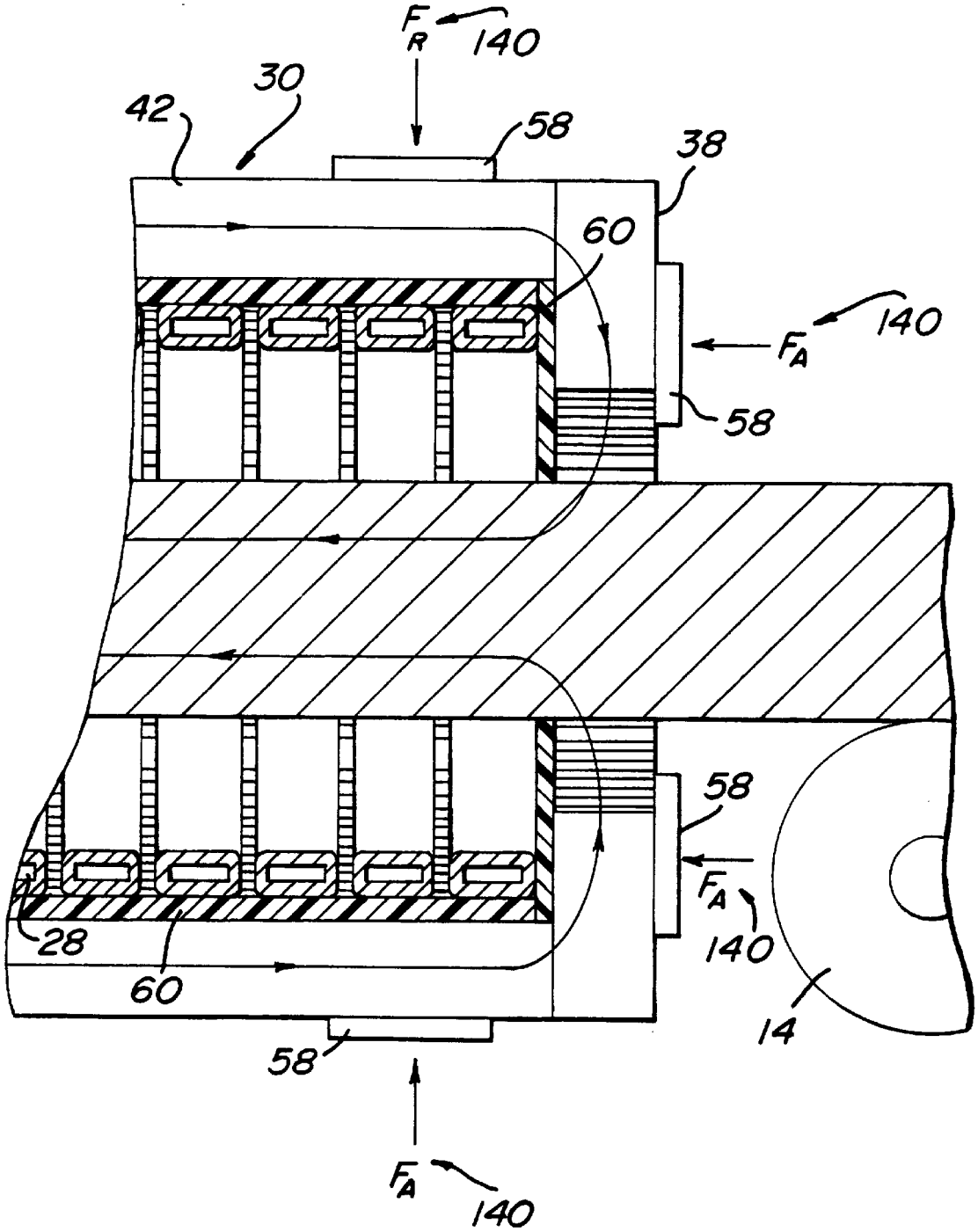
FIG. 9 is a partial sectional view of a coil assembly according to the invention in greater detail, showing insulating layers between the magnetic shunts and the coil turns.

FIG. 9 illustrates a plurality of clamps 58 on intermediate yokes 42 and on transverse end yokes 38. Clamps 58 apply compressive forces on the coil turns. The compressive forces on the intermediate yokes 42 are radial, as represented by arrows $F_R$, and the compressive forces on the end yokes 38 are axial, as represented by arrows $F_A$. Clamps 58 may have any shape or structure designed to apply the compressive forces to the yokes and coil. To prevent electric shorting between the coil turns, the yokes are insulated from the coil turns by insulating spacers 60. Spacers 60 may be any suitable nonconducting, nonmagnetic material.

Figure 10:
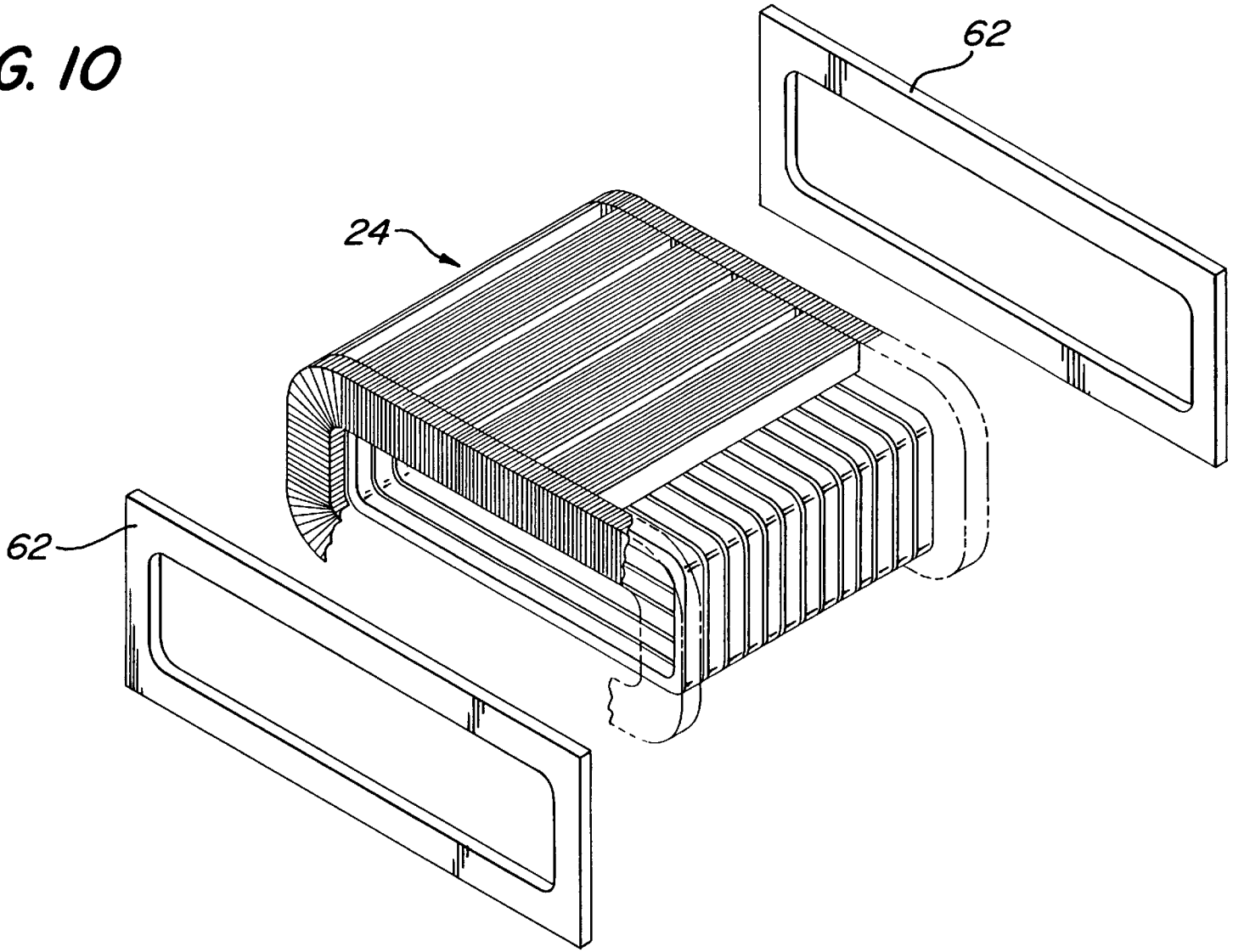
FIG. 10 is an exploded view of a coil assembly according to the invention, showing optional magnetic shunt end plates.

While the shunt arrangements already described are highly effective in directing the magnetic flux produced by the coil 28, it is possible to improve performance even more by using electrically-conductive magnetic flux deflecting end plates, as shown in FIG. 10. FIG. 10 is an exploded view of a coil assembly 24 which includes end plates 62 at each end of coil assembly 24. End plates 62 are generally rectangular in shape and have dimensions slightly greater than the overall outside dimensions of coil assembly 24. Each end plate 62 has a generally rectangular opening 64 in its center to accommodate passage of a workpiece through the opening. Opening 64 is approximately the same size and shape as the opening in coil assembly 24 through which the workpiece passes. End plates are preferably made of copper, which is a good conductor of electricity and deflects the magnetic flux with minimal losses. The end plates 62 are located adjacent and axially outside the end yokes 34 and 38. Preferably, the end plates are located a short distance from the end yokes, and should not touch the end yokes. It is within the scope of the invention to place an insulating spacer between the end plates 62 and the end yokes, if it is desired to also clamp the end plates 62 against the end yokes to further compress the induction coil 28.

Even with the use of the shunt assemblies previously described, stray magnetic flux from coil assembly 24 may reach the rollers 14 and 16, particularly if the rollers are in close proximity to the ends of the coil assembly. This stray flux may induce parasitic currents to flow in the rollers, and negate the effect of the shunts. The end plates 62 direct any stray flux which might otherwise escape from the center opening of coil assembly 24 to the end yokes 34 and 38, and from there to the intermediate yokes 42. In addition, the end plates 62 significantly improve the flux concentration within the coil.

The invention described above provides an alternative approach to preventing the flow of significant parasitic currents along a workpiece, thereby eliminating arcing between the moving workpiece and the conveyor rolls. Since it is no longer necessary to employ special conveyor rolls or insulating schemes to prevent damage to the conveyor rolls from such currents, roller induction heating becomes easier and cheaper than prior approaches.

Another embodiment of the present invention adds flexibility to the way the invention may be employed on a strip material processing line. On a rolled metal production line, it is common for a continuous caster to produce strip metals, feeding the strip metal from a watercooled mold supplied from a supply of liquid metal. The strip metal proceeds toward a roller for further processing. When the strip metal emerges from the caster, the outside surface of the metal has been cooled by the watercooled mold while the inside of the strip remains much hotter.

Before rolling the newly cast strip product, it is necessary to reheat the outer surface of the strip so that it is malleable during the rolling operation. Induction heating is quicker than gas heating, so the coil of the present invention is a desirable apparatus with which to heat the new metal.

However, there are potential problems in the strip material production process that can put the first embodiment of the present invention at risk of damage. If the caster runs too fast, or the watercooled mold does not cool the strip material evenly, a "whale" may develop in the new strip. A "whale" is a soft spot in the strip where the metal may remain semi-liquid. Gravity may cause the semi-liquid portion to sag and form a blob of metal that could contact part of the coil apparatus described above, damaging it severely.

The second embodiment of the present invention offers an alternative apparatus incorporating a similar magnetic yoke and shunt arrangement while allowing more flexibility in the way the apparatus can be handled on the processing line.

The first described embodiment of the present invention is a solid coil wrapping completely around the metal strip. To remove the strip from the coil it is necessary to sever the strip material. The second embodiment described below is open at one end, allowing the coil apparatus to be moved over, and removed from, the strip material without breaking the line. If a "whale" is encountered in new strip metal, the coil is simply removed from the strip, the "whale" is moved past the coil, then the coil apparatus is returned to the strip and the line may continue. It is a much less labor-intensive effort to remove the coil from the strip than to remove the strip from within the coil.

Accordingly, the second embodiment of the invention comprises a multi-turn induction coil apparatus having magnetic suppression of orthogonal fields that may create a current flowing along the longitudinal axis of the workpiece. This second embodiment of induction heating apparatus incorporating the magnetic yokes for confining the magnetic field also permits the heating apparatus to be moved on to, and to be removed from, strip material in place.

Figure 12:
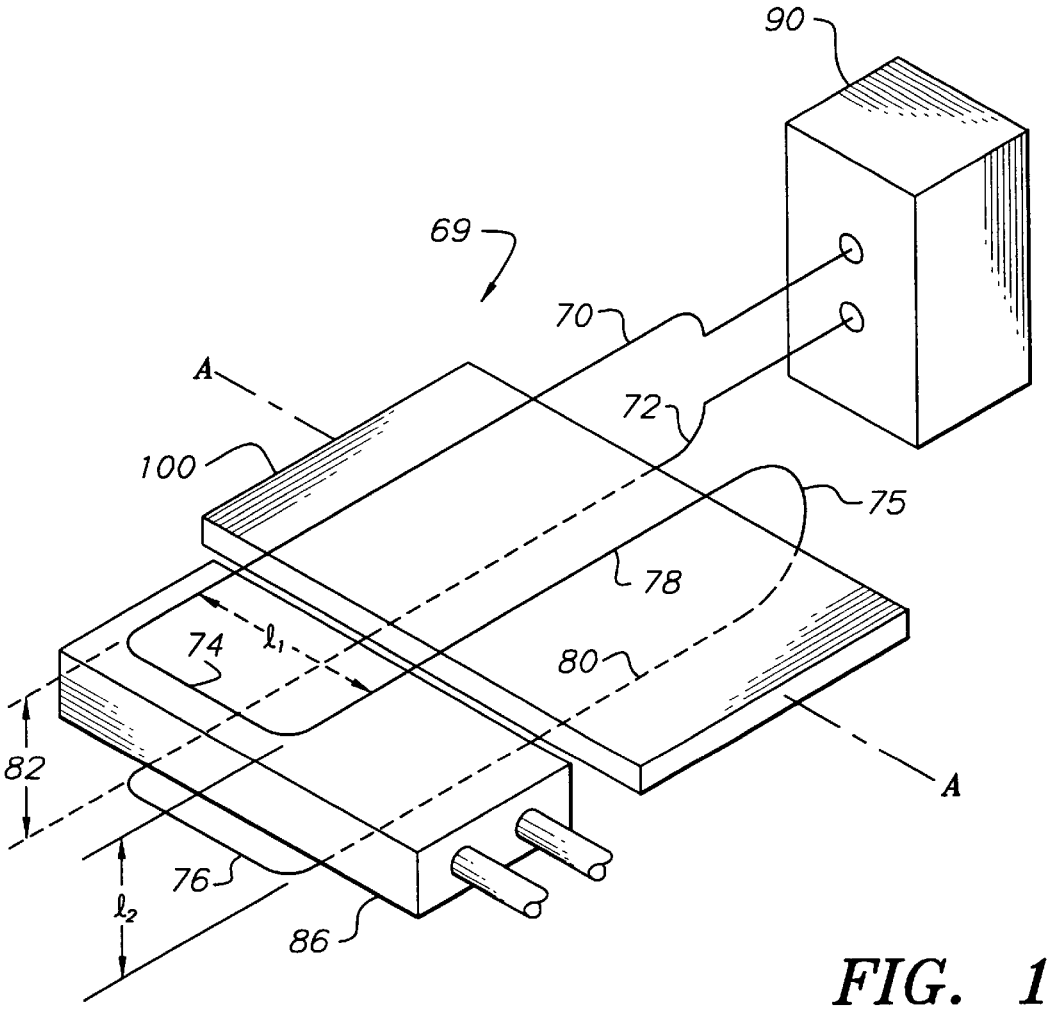
FIG. 12 is a simplified line diagram of the configuration of the underlying coil structure of the second described embodiment of the invention.

Referring to FIG. 12, this induction heating apparatus 69 comprises a plurality of elongated induction segments 70, 72, 78, 80 arranged as complementary pairs of coil turns. First and second induction segments 70, 72 are arranged parallel to each other and spaced apart sufficiently for a strip material workpiece 100 to pass between them. The first and second induction segments 70, 72 are arranged transverse to the longitudinal axis A of the workpiece 100. At one end, the induction segments 70, 72 are connected to first and second linking segments 74, 76. The connections form substantially right angles between the respective induction 70, 72 and linking segments 74, 76. That end of the first and second induction segments 70, 72 that is opposite the end connected by the linking segments 74, 76 is connected to an alternating current power supply 90, one pole of the power supply being connected to each of the first and second segments 70, 72.

The two linking induction segments 74, 76 connect the first and second induction segments 70, 72 to third and fourth induction segments 78, 80. The linking segments 74, 76 connect to the induction segments 70, 72, 78, 80 at substantially right angles such that the linking segments parallel the longitudinal axis A of a strip material workpiece 100. The first and second linking segments 74, 76 are of equal length, shown as dimension $l_1$ in FIG. 12.

The third and fourth induction segments 78, 80 are also arranged parallel to each other and spaced apart sufficiently for the strip material 100 to pass between them. The third and fourth segments 78, 80 extend back across the workpiece from the point of connection to the linking segments 74, 76. The third and fourth segments 78, 80 are connected to each other by a spanning segment 75 at their end opposite the end that is connected to the linking segments.

As described, the induction heating apparatus 69 forms a multi-turn induction coil. There is a continuous conduction path formed from a first pole of the power supply 90, through the first induction segment 70, the first linking segment 74, the third and fourth induction segments 78, 80, the second linking segment 76 and back through the second induction segment 72 to the second pole of the power supply 90. The combination of the first and second induction segments 70, 72 form one full turn of the coil apparatus, the third and fourth induction segments 78, 80 form a second full turn. Other embodiments of the invention described herein may be constructed having more than two full turns without departing from the spirit and scope of the invention. For example, referring to FIG. 16, a third full turn could be added to the apparatus by adding two more linking segments 102, 104 and two more elongated induction segments (not visible) spanning the workpiece 100.

Referring again to FIG. 12, a gap 82 exists between the two linking segments 74, 76 at one end of the apparatus. The gap 82, like the space between the first and second induction segments 70, 72 and third and fourth induction segments 78, 80, is of sufficient dimension to permit the workpiece 100 to pass edgewise into and out of the induction apparatus 69. In FIG. 12 the gap 82 dimension is indicated as $l_2$, which must be a dimension larger than the thickness of the metal strip to be heated. This permits the apparatus to be moved over and removed from a standing strip, slab, or bar workpiece.

Figure 14:
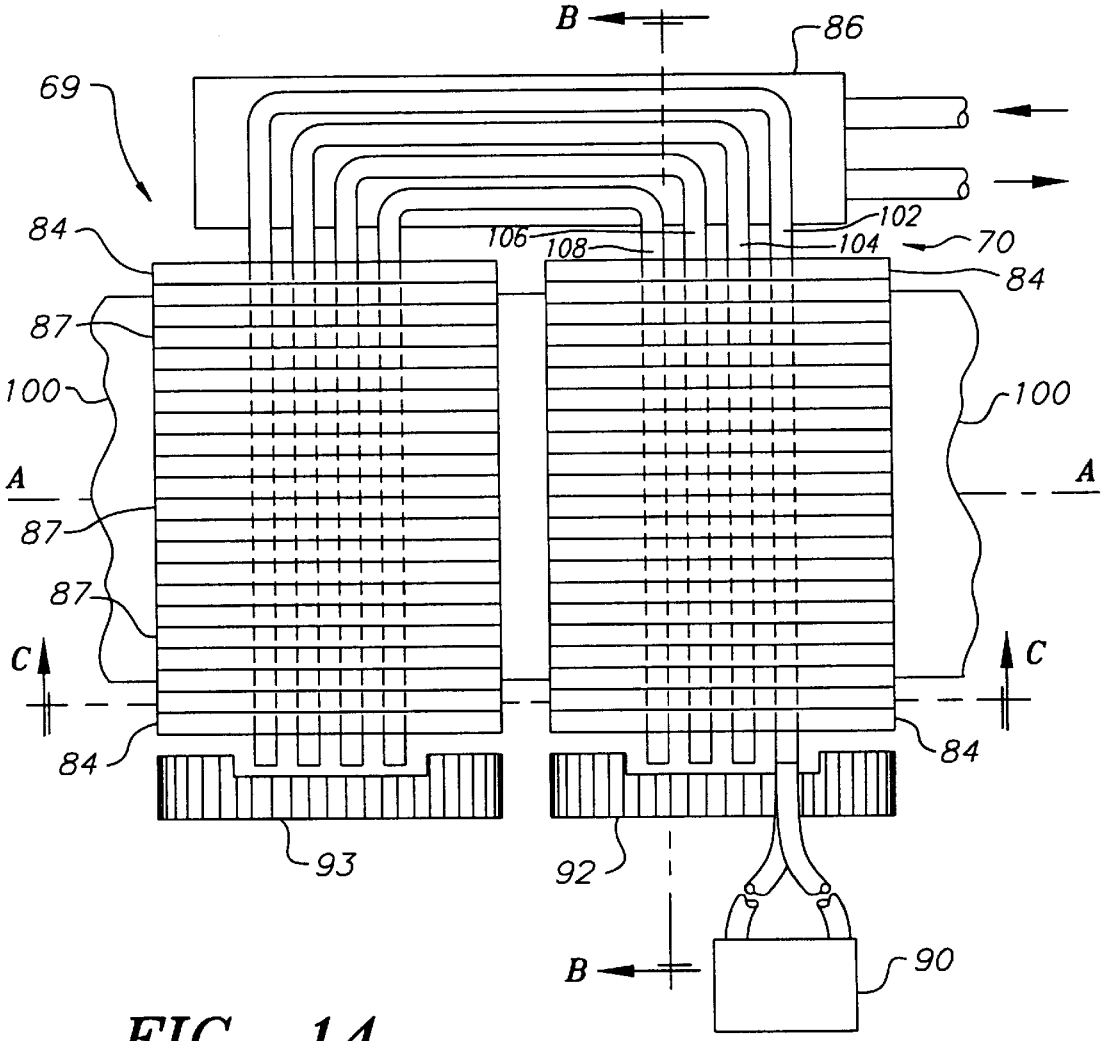
FIG. 14 is a top plan view of the second described embodiment of the invention.
Figure 15:
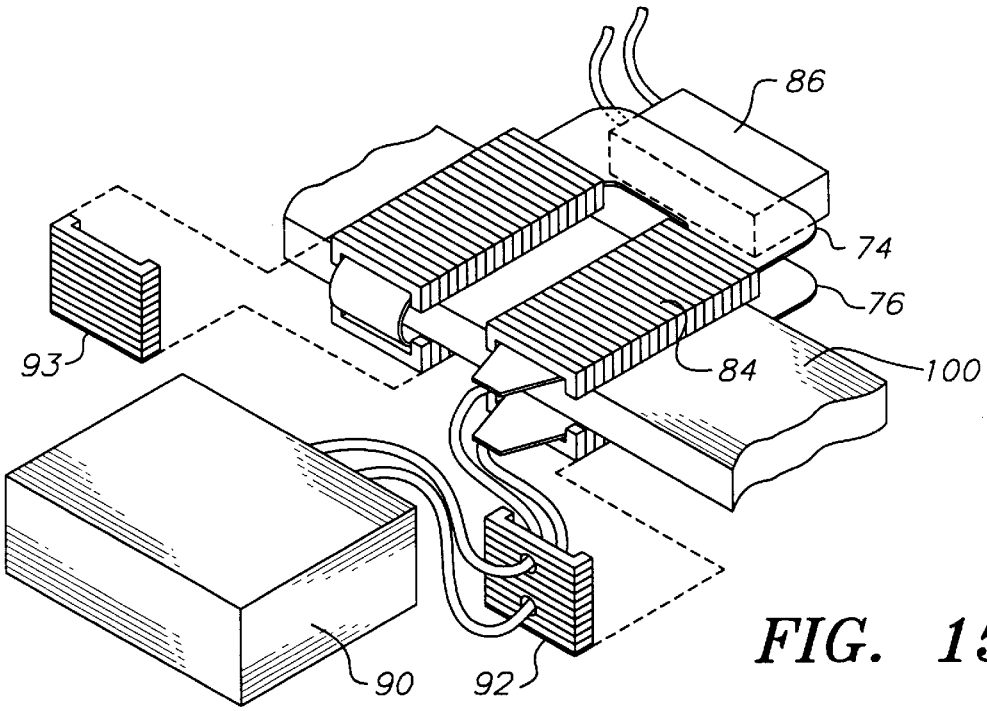
FIG. 15 is a perspective view of the second described embodiment of the invention.
Figure 16:
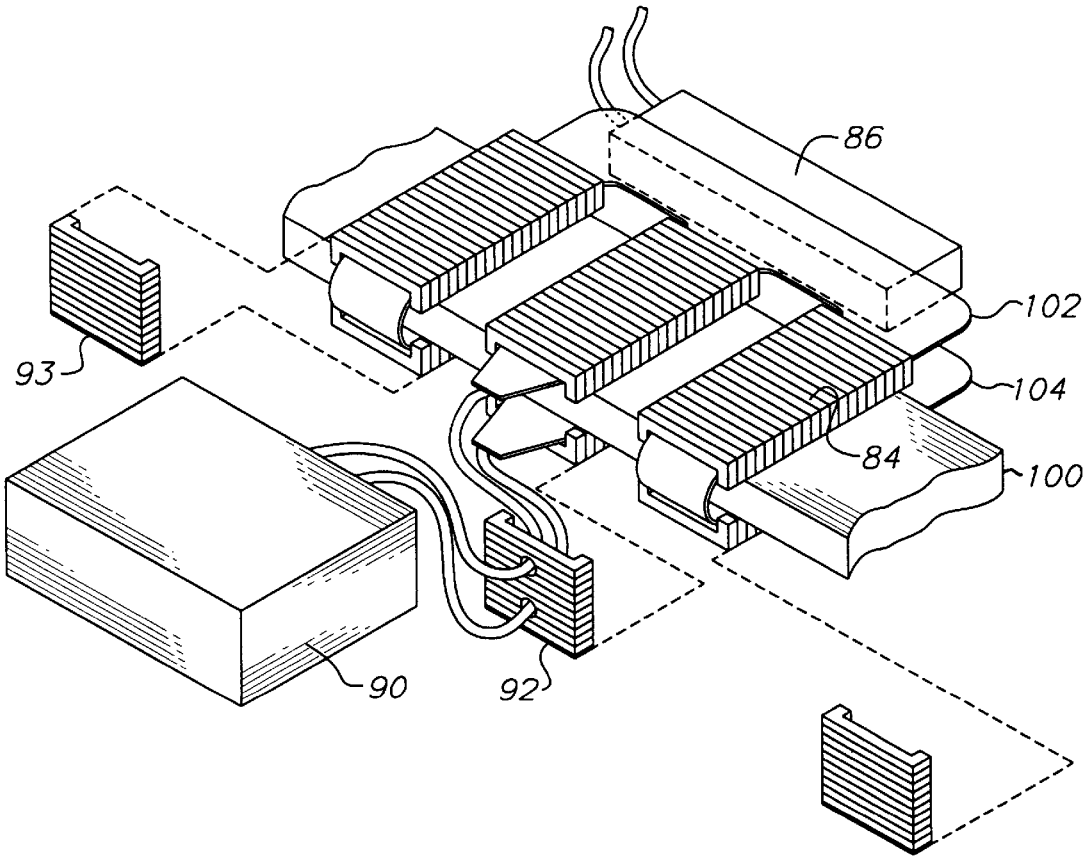
FIG. 16 is a perspective view of a third embodiment of the invention.

The subject embodiment of the invention has been described as though the constituent inductive segments and linking segments comprising the coil apparatus were solid, singular conductors. Though this may be the case, as is shown in FIGS. 15 and 16, it is not necessarily so. Referring to FIG. 14, it can be seen that the first elongated induction segment 70 may comprise several individual lengths of conductor material 102, 104, 106, 108. So, too, may the remaining inductor and linking segments comprise several individual conductors, as is the case in the preferred form of this embodiment of the invention.

Figure 13:
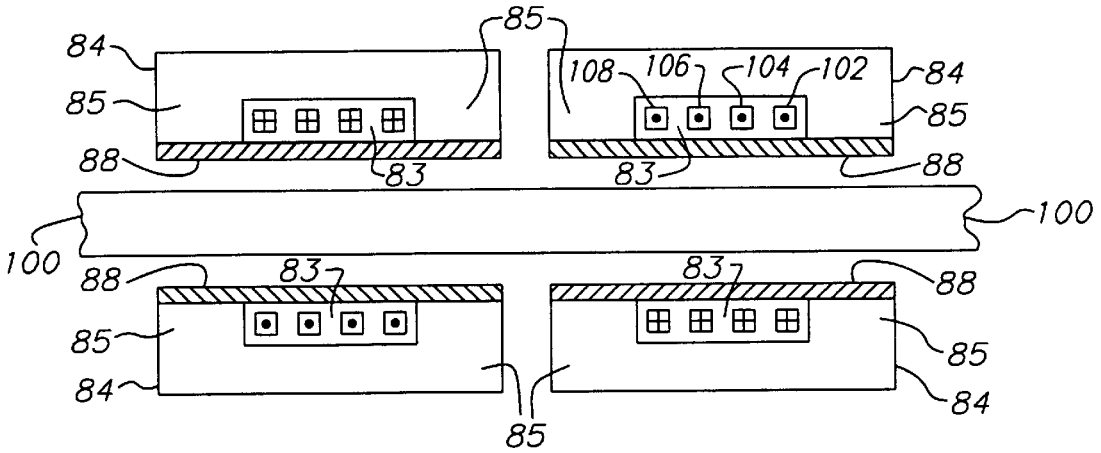
FIG. 13 is a sectional view of the second described embodiment of the invention, taken along the line C—C in FIG. 14.

Referring to FIG. 14, the coil apparatus further comprises magnetic yokes 84 for directing the magnetic field to be aligned with the longitudinal axis of the workpiece. See also FIGS. 11 and 15. A plurality of magnetic yokes 84 are disposed along the respective first through fourth elongated induction segments 70, 72, 78, 80. The plurality of magnetic yokes 84 are arranged along the elongated induction segments 70, 72, 78, 80 in a manner comparable to that described earlier for the intermediate yokes 40 shown in FIG. 2A. The individual magnetic yokes are arranged transverse to the direction of current flow in the associated elongated induction segment, as shown in FIG. 13. The direction of current flow in FIG. 13 is indicated in the induction segments 102, 104, 106, 108 by dots (•) meaning the current flows toward the observer. A "+" indicates current flow away from the observer.

Referring to FIG. 14, each of the magnetic yokes 84 is spaced apart from each other by identically shaped non-conductive spacers 87, the yokes 84 and spacers 87 alternating in a stacked manner across the elongated inductor segments 70, 72, 78, 80. The individual magnetic yokes 84 are aligned parallel to the longitudinal axis A of the strip material workpiece 100 that passes through the coil apparatus. The magnetic yokes 84 and spacers 87 may be arranged in a plurality of groupings, each grouping separated by a relatively small air gap, as shown in FIG. 2A for the first described embodiment of the present invention.

The plurality of magnetic yokes 84 extends along each of the elongated inductor segments 70, 72, 78, 80 for a distance at least sufficient to equal the width of the workpiece 100, and may extend beyond that width. See FIGS. 11, 14 and 15. The plurality of magnetic yokes 84 need not encompass the surfaces of the linking inductor segments 74, 76.

As shown in FIG. 13, each of the magnetic yokes 84 extends across its associated elongated induction segment. Each yoke 84 has an interior space 83 into which the elongated induction segment(s) may fit. The interior space 83 may be filled with a non-conductive, non-magnetic material, such as ceramic. Bordering the interior space 83 are projections 85 that encompass the edges of elongated induction segment. Thermoinsulating material 88 protects both the magnetic yokes 84 and the elongated induction segment from the heat of the workpiece 100.

Figure 11:
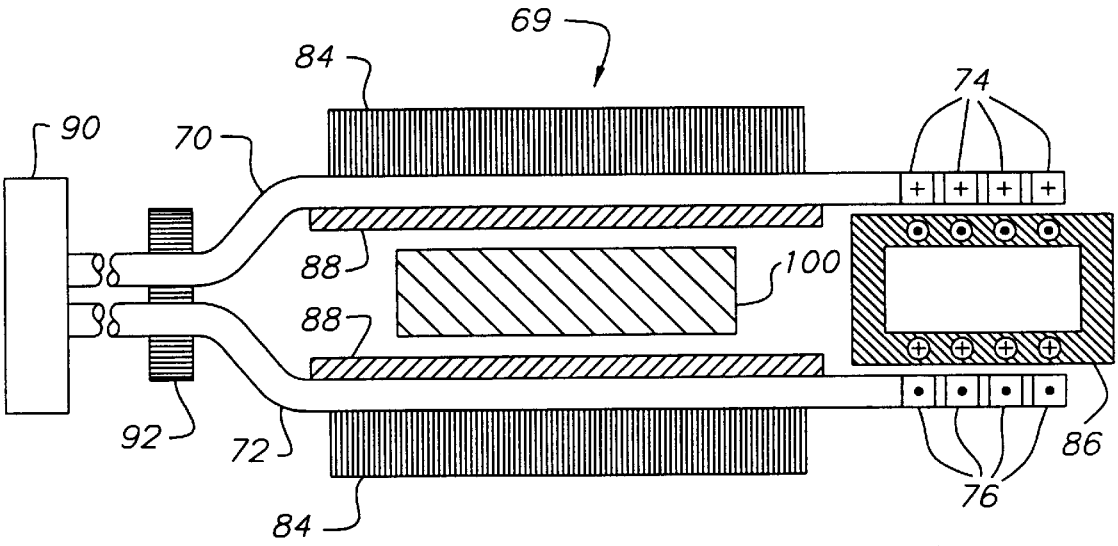
FIG. 11 is a sectional view of the second described embodiment of the invention, taken along the line B—B in FIG. 14.

Referring to FIGS. 11, 12 and 14, a magnetic field reducer 86 and magnetic shunts 92, 93 are employed to direct the magnetic fields at the respective ends of the coil apparatus. The magnetic field reducer 86 is a box-shaped magnetic element that is placed within the gap 82 at the open end of the coil apparatus. As shown in FIG. 11, the magnetic field reducer 86 is disposed between the two linking inductor segments 74, 76 (shown comprising several conductors) at the end of the coil apparatus, concentrating the magnetic field produced by the linking segments 74, 76 into a small area in close proximity to the coil. Depending on its size, the magnetic field reducer 86 may require active cooling by pumping water or other coolant through one or more channels within the reducer during operation. The magnetic field reducer 86 does not contact any of the induction segments of the coil, remaining separated by a small air gap from the linking induction segments.

As shown in FIGS. 14 and 15, the magnetic shunts 92, 93 are employed at the opposite end of the coil from the linking inductors 74, 76 and magnetic field reducer 86. The magnetic shunts 92, 93 are magnetic elements placed in close proximity to the closed end of the coil apparatus 69. One magnetic shunt 92 is associated with the power supply end of the first and second elongated induction segments 70, 72. The other magnetic shunt 93 is associated with the closed (connected) end of the third and fourth elongated induction segments 78, 80. The magnetic shunts 92, 93 serve to confine the induction magnetic field at the closed end and provide magnetic coupling to the magnetic yokes 84 closest to that end of the coil.

Referring to FIGS. 11 and 13, the coil apparatus further comprises segments of thermoinsulating material 88 disposed on the surface of the respective first through fourth elongated induction segments 70, 72, 78, 80 that faces (i.e., is closest to) the workpiece 100. This material protects the coil apparatus from damage that may result from being in close proximity to a very hot workpiece.

The magnetic yokes 84 of the embodiment of the invention shown in FIG. 15 are directly analogous to the magnetic yokes 40 shown in FIG. 2A combined with the transverse yokes 34 shown in FIG. 2. The projections 85 on the yokes 84 in FIG. 13 serve the same purpose as the transverse yokes 40 shown in FIG. 2A. They prevent the magnetic field created by the inductive effect of the elongated induction segments 70, 72, 78, 80 from spreading out in all directions from the edges of the induction segments. The magnetic shunts 92, 93 serve the same purpose at the closed end of the coil apparatus. Thus, non-negligible components of the magnetic field perpendicular to the longitudinal axis of the workpiece 100 are suppressed, preventing parasitic eddy currents from flowing along the longitudinal axis of the workpiece 100.

The present invention may be embodied in other specific forms without departing from the spirit or essential attributes thereof and, accordingly, reference should be made to the appended claims, rather than to the foregoing specification, as indicating the scope of the invention.

We claim:

1. An induction heating apparatus for a sheet, slab or bar workpiece having a longitudinal axis, comprising:

a coil apparatus comprising first and second elongated induction segments each having first and second ends, said first and second elongated induction segments being arranged substantially parallel to each other and extending across opposite surfaces of a workpiece transverse to said longitudinal axis, third and fourth elongated induction segments, each having first and second ends respectively, said first and second elongated segments being connected at their first ends by first and second linking induction segments to the first end of the third and fourth elongated induction segments respectively, said third and fourth elongated induction segments being arranged substantially parallel to each other and extending across opposite surfaces of the workpiece, transverse to said longitudinal axis, said third and fourth elongated segments being connected to each other by a spanning segment on the second end opposite the first end, a gap between said first and second linking induction segments, said gap having a dimension sufficient to enable the workpiece to be passed edgewise between the induction segments for placement within the coil apparatus, such that the coil apparatus is adapted to be moved to selectably encompass and be removed from the workpiece;

said induction heating apparatus further comprising a plurality of magnetic yokes disposed on a surface of the first, second, third and fourth induction segments respectively, said surface being that surface facing away from the workpiece, said magnetic yokes being arranged parallel to and spaced apart from each other and parallel to the longitudinal axis of the workpiece, said magnetic yokes extending along each of said first through fourth elongated segments for a distance at least equal to the width of the workpiece;

and a magnetic field reducer located within the gap between the linking induction segments to restrict magnetic flux outside the induction apparatus.

2. An induction heating apparatus as in claim 1 wherein, each of said first through fourth elongated induction segments has a surface facing the workpiece, and the apparatus further comprises thermoinsulating material on said surface.

3. The induction heating apparatus of claim 1, further comprising an alternating current power supply connected to the second ends of the first and second elongated induction segments.

4. The induction heating apparatus of claim 1, further comprising magnetic shunts applied to the second ends of the first and second elongated induction segments and the third and fourth elongated induction segments, respectively.

5. The induction heating apparatus of claim 4, wherein the magnetic shunt on the second ends of the respective first and second elongated induction segments and third and fourth elongated induction segments is separated from the magnetic yokes by non-conductive material.

6. The induction heating apparatus of claim 5, wherein the non-conductive material separating the magnetic yokes and the magnetic shunts is air.

7. The induction heating apparatus of claim 1, wherein the first through fourth elongated induction segments comprise a plurality of conductors.

8. The induction heating apparatus of claim 5, wherein the linking induction segments comprise a plurality of conductors.

9. The induction heating apparatus of claim 1, wherein the magnetic yokes are arranged in a plurality of spaced groupings along the surface of the first through fourth induction segments.

10. The induction heating apparatus of claim 1, wherein the elongated induction segments comprise a plurality of conductors.

11. The induction heating apparatus of claim 10, wherein the linking segments comprise a plurality of conductors.

12. In the induction heating apparatus of claim 1, wherein the magnetic field reducer comprises a closed structure having a plurality of sides of electrically conductive material.

13. An induction heating apparatus for heating strip material comprising a coil apparatus comprising a first elongated induction segment having first and second ends, a first linking induction segment having length $l_1$ connected to said first elongated induction segment at its first end and coplanar with said first segment, forming substantially a right angle at the connection, a second elongated induction segment having first and second ends arranged parallel to and spaced apart from the first elongated segment by the length $l_1$ of the first linking induction segment, said second elongated segment being connected at its first end to the first linking segment at substantially a right angle and coplanar with said linking segment, a third elongated induction segment having first and second ends, said third elongated segment being connected at its first end to the second end of the second elongated segment by a spanning segment, said spanning segment being arranged substantially perpendicular to a plane extending through both the first and second elongated segments, said third elongated segment being arranged substantially parallel to the second elongated segment and separated from it by a gap of distance $l_2$, a second linking segment connected to the second end of the third elongated segment, said second linking segment being arranged parallel to the first linking segment, said second linking segment being separated from the first linking segment by a gap of distance $l_2$, a fourth elongated induction segment having first and second ends, said fourth elongated segment being connected at its first end to the second linking segment at substantially a right angle to said linking segment, said fourth elongated segment being arranged parallel to the first elongated segment and separated from it by a gap of distance $l_2$;

said induction heating apparatus further comprising a plurality of magnetic yokes disposed on a surface of the first, second, third and fourth elongated induction segments respectively, said surface being that surface facing away from the gap between the first and fourth and the second and third elongated segments respectively, said magnetic yokes being arranged parallel to and spaced apart from each other and parallel to the linking segments of the apparatus, said plurality of magnetic yokes extending along the elongated dimension of each of said first through fourth elongated segments;

and a magnetic field reducer located within the gap between the linking segments to restrict magnetic flux outside the induction apparatus.

14. An induction heating apparatus as in claim 13 wherein, each of said first and fourth elongated induction segments has a surface facing the other, and each of said second and third elongated induction segments has a surface facing the other, and the apparatus further comprises thermoinsulating material on said facing surfaces of the elongated induction segments.

15. The induction heating apparatus of claim 13, further comprising an alternating current power supply connected to the second ends of the first and fourth elongated induction segments.

16. The induction heating apparatus of claim 13, further comprising first and second magnetic shunts, said first magnetic shunt being arranged over the second ends of the first and fourth elongated segments, said second magnetic shunt being arranged over the spanning segment connecting one end of the second and third elongated induction segments.

17. The induction heating apparatus of claim 16, wherein the magnetic shunts are separated from the magnetic yokes by non-conductive material.

18. The induction heating apparatus of claim 16, wherein the non-conductive material separating the magnetic yokes and the magnetic shunts is air.

19. The induction heating apparatus of claim 13, wherein the first through fourth elongated segments comprise a plurality of conductors.

20. The induction heating apparatus of claim 19, wherein the linking induction segments comprise a plurality of conductors.

21. The induction heating apparatus of claim 13, wherein the magnetic yokes are arranged in a plurality of spaced groupings along the surfaces of the first through fourth elongated segments.

22. An induction heating apparatus for heating strip material comprising a coil apparatus comprising a plurality of elongated induction segments and a plurality of linking segments, said elongated segments being arranged in substantially parallel pairs and having first and second ends, each of the respective elongated segments in each pair being arranged parallel to each other and having a gap between them, said parallel pairs of induction segments being connected at their first ends by parallel linking segments such that the linking segments are also separated from each other by a gap, each pair of elongated induction segments except one being connected at their respective second ends by a short spanning segment, said one pair being connected at its respective second ends to an alternating current power supply;

said induction heating apparatus further comprising a plurality of magnetic yokes disposed on a surface of each of the plurality of respective elongated induction segments, said surface being that surface facing away from the gap, said magnetic yokes being arranged parallel to and spaced apart from each other and parallel to the linking segments, said plurality of magnetic yokes extending along the elongated dimension of each of said plurality of elongated induction segments;

and a magnetic field reducer located within the gap between the linking segments to restrict magnetic flux outside the induction apparatus.

23. An induction heating apparatus as in claim 19 wherein, each of said elongated induction segments in a pair has a surface facing the gap between them, and the apparatus further comprises thermoinsulating material on said facing surface of each constituent elongated induction segment in each respective pair.

24. The induction heating apparatus of claim 22, further comprising an alternating current power supply connected to one of the pairs of elongated induction segments.

25. The induction heating apparatus of claim 22, further comprising a plurality of magnetic shunts, each of said shunts except one being arranged over the spanning segments connecting a pair of elongated conductors.

26. The induction heating apparatus of claim 25, wherein said one magnetic shunt is arranged over the end of the pair of elongated induction segments that is connected to the power supply.

27. The induction heating apparatus of claim 25, wherein the magnetic shunts are separated from the magnetic yokes by non-conductive material.

28. The induction heating apparatus of claim 27, wherein the non-conductive material separating the magnetic yokes and the magnetic shunts is air.

29. The induction heating apparatus of claim 22, wherein the magnetic yokes are arranged in a plurality of spaced groupings along said surface of the elongated induction segments.

30. In the induction heating apparatus of claim 22, wherein the magnetic field reducer comprises a closed structure having a plurality of sides of electrically conductive material.

31. An induction heating apparatus for a sheet, slab or bar workpiece having a longitudinal axis, comprising:

a coil apparatus comprising first and second elongated induction segments each having first and second ends, said first and second elongated induction segments being arranged substantially parallel to each other and extending across opposite surfaces of a workpiece transverse to said longitudinal axis, third and fourth elongated induction segments each having first and second ends respectively, said first and second elongated segments being connected at their first ends by first and second linking induction segments to the first end of the third and fourth elongated induction segments respectively, said third and fourth elongated induction segments being arranged substantially parallel to each other and extending across opposite surfaces of the workpiece, transverse to said longitudinal axis, said third and fourth elongated segments being connected to each other by a spanning segment on the second end opposite the first end, a gap between said first and second linking induction segments, said gap having a dimension sufficient to enable the workpiece to be passed edgewise between the induction segments for placement within the coil apparatus, such that the coil apparatus is adapted to be moved to selectably encompass and be removed from the workpiece;

said induction heating apparatus further comprising a magnetic field reducer located within the gap between the linking induction segments to restrict magnetic flux outside the induction apparatus.

32. An induction heating apparatus as in claim 31 wherein, each of said first through fourth elongated induction segments has a surface facing the workpiece, and the apparatus further comprises thermoinsulating material on said surface.

33. The induction heating apparatus of claim 31, further comprising an alternating current power supply connected to the second ends of the first and second elongated induction segments.

34. The induction heating apparatus of claim 31, wherein the first through fourth induction segments comprise a plurality of conductors.

35. The induction heating apparatus of claim 34, wherein the linking induction segments comprise a plurality of conductors.

36. In the induction heating apparatus of claim 22, wherein the magnetic field reducer comprises a closed structure having a plurality of sides of electrically conductive material.

37. An induction heating apparatus for heating strip material comprising a coil apparatus comprising a first elongated induction segment having first and second ends, a first linking induction segment having length $l_1$ connected to said first elongated induction segment at its first end and coplanar with said first segment, forming substantially a right angle at the connection, a second elongated induction segment having first and second ends arranged parallel to and spaced apart from the first elongated segment by the length $l_1$ of the first linking induction segment, said second elongated segment being connected at its first end to the first linking segment at substantially a right angle and coplanar with said linking segment, a third elongated induction segment having first and second ends, said third elongated segment being connected at its first end to the second end of the second elongated segment by a spanning segment, said spanning segment being arranged substantially perpendicular to a plane extending through both the first and second elongated segments, said third elongated segment being arranged substantially parallel to the second elongated segment and separated from it by a gap of distance $l_2$, a second linking segment connected to the second end of the third elongated segment, said second linking segment being arranged parallel to the first linking segment, said second linking segment being separated from the first linking segment by a gap of distance $l_2$, a fourth elongated induction segment having first and second ends, said fourth elongated segment being connected at its first end to the second linking segment at substantially a right angle to said linking segment, said fourth elongated segment being arranged parallel to the first elongated segment and separated from it by a gap of distance $l_2$;

said induction heating apparatus further comprising a magnetic field reducer located within the gap between the linking segments to restrict magnetic flux outside the induction apparatus.

38. An induction heating apparatus as in claim 37 wherein, each of said first and fourth elongated induction segments has a surface facing the other, and each of said second and third elongated induction segments has a surface facing the other, and the apparatus further comprises thermoinsulating material on said facing surfaces of the elongated induction segments.

39. The induction heating apparatus of claim 37, further comprising an alternating current power supply connected to the second ends of the first and fourth elongated induction segments.

40. The induction heating apparatus of claim 37, wherein the first through fourth induction segments comprise a plurality of conductors.

41. The induction heating apparatus of claim 40, wherein the linking induction segments comprise a plurality of conductors.

42. An induction heating apparatus for heating strip material comprising a coil apparatus comprising a plurality of elongated induction segments and a plurality of linking segments, said elongated segments being arranged in substantially parallel pairs and having first and second ends, each of the respective elongated segments in each pair being arranged parallel to each other and having a gap between them, said parallel pairs of elongated induction segments being connected at their first ends by parallel linking segments such that the linking segments are also separated from each other by a gap, each pair of elongated induction segments except one being connected at their second ends by a short spanning segment, said one pair being connected at its respective second ends to an alternating current power supply;

said induction heating apparatus further comprising a magnetic field reducer located within the gap between the linking segments to restrict magnetic flux outside the induction apparatus.

43. An induction heating apparatus as in claim 42 wherein, each of said elongated induction segments in a pair has a surface facing the gap between them, and the apparatus further comprises thermoinsulating material on said facing surface of each elongated induction segment in each respective pair.

44. The induction heating apparatus of claim 42, further comprising an alternating current power supply connected to one of the pairs of elongated induction segments.

45. The induction heating apparatus of claim 42, wherein the elongated induction segments comprise a plurality of conductors.

46. The induction heating apparatus of claim 45, wherein the linking segments comprise a plurality of conductors.

47. In the induction heating apparatus of claim 42, wherein the magnetic field reducer comprises a closed structure having a plurality of sides of electrically conductive material.

* * * * *